United States Patent [19]

Hubbard

[11] Patent Number: 4,854,762

[45] Date of Patent: Aug. 8, 1989

[54] DISPOSABLE MARKER AND ADAPTER FOR PEN-DRIVEN INTEGRATOR

[75] Inventor: James R. Hubbard, Morrestown, N.J.

[73] Assignee: Graphic Controls Corporation, Buffalo, N.Y.

[21] Appl. No.: 3,131

[22] Filed: Jan. 14, 1987

[51] Int. Cl.[4] ..... B43K 31/00

[52] U.S. Cl. ..... 401/199; 401/195; 401/202; 346/140 A

[58] Field of Search ..... 401/198, 199, 202, 213, 401/196, 6, 195; 346/140 A, 140 R; D19/41; 33/18.1, 27.01, 23.04; 403/299, 361; 279/1 A

[56] References Cited

U.S. PATENT DOCUMENTS

| | | | |
|---|---|---|---|
| 3,189,005 | 6/1965 | Hansen et al. | 33/18.1 |
| 3,325,851 | 6/1967 | Roller, Sr. | 401/198 |
| 3,396,469 | 8/1968 | Brott | 33/23.04 |
| 3,893,130 | 7/1975 | Browning et al. | 401/199 X |

FOREIGN PATENT DOCUMENTS

| | | | |
|---|---|---|---|
| 816664 | 10/1951 | Fed. Rep. of Germany | 401/95 |
| 19977 | 9/1907 | United Kingdom | 401/95 |

OTHER PUBLICATIONS

Dia-Nielson, USA Inc. Catalog, Pre 11/13/84, note p. 3.

Journal of Chemical Engineering, Oct./1970, p. 716, bottom.

*Primary Examiner*—Richard J. Apley
*Assistant Examiner*—Franklin L. Gubernick
*Attorney, Agent, or Firm*—Ratner & Prestia

[57] ABSTRACT

A disposable marker and adapter for use in an integrator pen. The forward end of the marker fits within the adapter and a nib holder, projecting from the front of the marker, is threadedly retained therein. The rear end of the adapter is adapted to be frictionally retained within a conventional integrator pen body holder.

5 Claims, 1 Drawing Sheet

DISPOSABLE MARKER AND ADAPTER FOR PEN-DRIVEN INTEGRATOR

BACKGROUND

This invention pertains to a disposable marker and adapter combination by which conventional pen-driven integrators can be modified for use with disposable markers.

For many years, graphical representations have been integrated by an integrator with which is associated a manually controlled device, normally a pen. The device is used to superimpose ink lines of contrasting shades over the original chart records of static and differential pressure and through a connector to provide an input which permits accumulating the average of the infinite number of square roots of products of absolute static pressures and differential pressures for the time period covered by the chart. In this conventional system, the integrator includes a pen connector upon which is mounted in turn a pen holder, the pen holder frictionally receiving a pen adapted to be received therein. Conventionally also, however, such pens include refillable liquid ink reservoirs. These are unfortunately subject to drying out and other types of failures. From time to time, the pens require refilling, a relatively delicate and sometimes messy maintenance task.

In other instrument applications, disposable pens have been adapted to replace liquid ink refillable pens, but the mode of adaptation is greatly dependent on the pre-existing instrument and pen structure.

In at least one known prior instrument adaptation, a disposable pen has been adapted for use on an XX recorder by self-threaded mating of the nib holder at the forward end of a plastic pen body with the internal threads of a pen holder in the instrument.

Notwithstanding the prior adaptations of markers and other instruments, there has heretofore not been a satisfactory adaptation for use in integrator pens, at least insofar as is known by the present inventor.

BRIEF DESCRIPTION OF THE INVENTION

The present invention comprises a disposable marker and adaptor for use in an integrator in which the pen body holder comprises a downwardly dependent cylindrical skirt. The disposable marker and adapter of the present invention comprises a cylindrical marker body, containing a fibrous ink reservoir, with a nib holder and nib projecting at the forward end thereof. This marker is combined with an adapter comprising a cylindrical member with an internal shape adapted to receive the forward end of the marker body and also to threadedly engage the nib holder. This adapter also includes, at its rearward end, means for being retained in the downwardly dependent cylindrical skirt of the pen body holder of a conventional integrator and pen assembly.

Preferably, the adapter includes a rearward cuff with an external diameter adapted to be received within the internal diameter of the downwardly dependent cylindrical skirt. Preferably also, forward of the reduced diameter rearward segement of the adapter, the external diameter of the adapter is enlarged to provide a shoulder for stopping against the forward end of the pen body holder sleeve. This enlarged diameter also provides greater torque for ease of assembly when threading the nib holder into the adapter.

In another aspect of the present invention, the diameter of the forward ends of the adapter and of the marker body are essentially the same, so that a common tip sealing cap may be used to seal the marker, prior to assembly, and then also to seal it, by mating with the adapter forward end, after assembly.

For a better understanding of the present invention, reference may be made to the accompanying figures, together with the detailed description thereof and the appended claims.

DETAILED DESCRIPTION OF THE INVENTION

Figure 1:
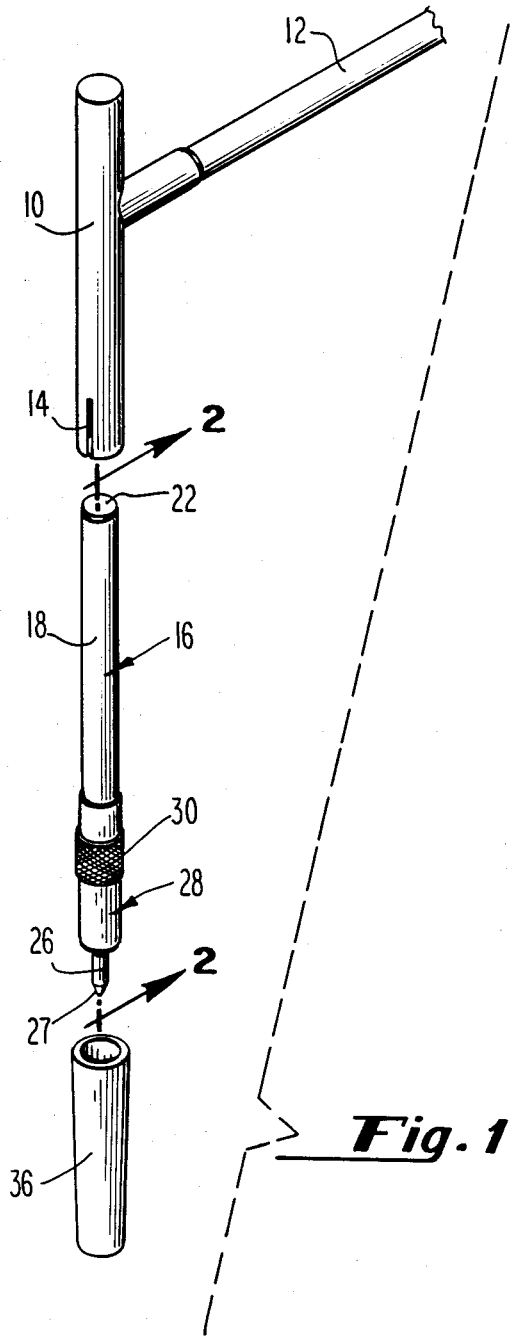
FIG. 1 is an exploded perspective view of the disposable marker and adapter of the present invention, shown with a conventional pen body holder and connnecting arm associated with a prior art integrator.

Referring specifically to FIG. 1, there is shown a pen body holder with a downwardly dependent sleeve, including slots 14 to permit frictional gripping of a member received in the internal diameter of the forward edge of pen body holder 10. Holder 10 is attached to pen connector arm 12 in turn associated with an integrator, not shown. A disposable marker 16 is adapted, in its rearward portion, to be received within holder 10. Marker 16 includes, as better seen in FIG. 2, a fibrous ink reservoir 20, a rear plug closure 22 and a marker body 18. At the forward end marker 16 includes a nib holder 24, through which protrudes and from the forward end of which extends a nib 26, with a nib tip 27 at the forward end thereof. Marker 16 is adapted to be retained in and used with pen body holder 10 by means of adapter member 28, normally including a knurled outer surface segment 30 for better finger gripping.

In this the preferred form of the present invention, adapter 28 includes a forward segment with internal threads 31 and a diameter adapted to threadedly receive the external fluted diameter of nib holder 24. Most preferably, nib holder 24 is molded of a soft plastic and is fluted so that it can be self-threading upon insertion in adapter 28.

Rearwardly, adapter 28 includes a segment having an internal diameter adapted to receive the forward end of marker body 18.

Preferably, adapter 28 is adapted to mate with and be retained by pen body holder 10 by a rearward cuff 32, namely, a rearward sub-segment having an external diameter adapted to be frictionally received within the internal diameter of the downward end of pen body holder 10. Preferably also, the rearward segment of adapter 28 includes a forward sub-segment of larger diameter than cuff 32 so as to provide a shoulder 34 which abuts the lower or forwrad end of pen body holder 10 when the adapter 28 and marker 16 are fully assembled with pen holder 10. Additionally, the larger diameter also provides greater torque when threading the nib holder into the adapter.

Figure 2:
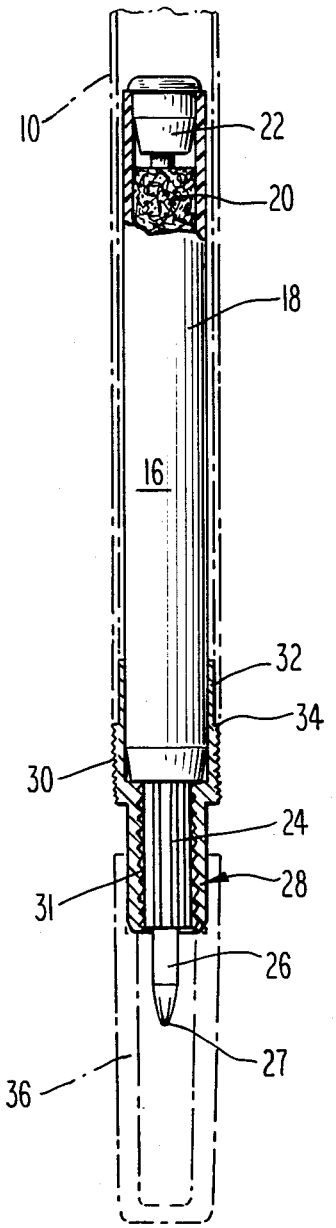
FIG. 2 is a sectional view, in the plane 2—2 of FIG. 1, showing details of the disposable marker and adapter of the present invention.

Also in accordance with the preferred form of the present invention, the external diameter of marker 16 at its forward end is the same as that of adaptor 28 at its forward end, as seen in FIG. 2. Thus, a common sealing cap 36 is adapted to cover, frictionally engage and seal either the forward end of marker 16 before assembly with adapter 28 or the forward end of marker 16 and adapter 28, after assembly.

While this invention has been described with reference to specific, and particularly preferred, embodiments thereof, it is not limited thereto and the appended claims are intended to be construed to encompass not only the specific forms and variants of the invention shown but to such other forms and variants as may be devised by those skilled in the art without departing from the true spirit and scope of this invention.

Accordingly, I claim:

1. Disposable marker and adapter for use with a pen body holder having a sleeve, said marker comprising a cylindrical marker body having a closed rear end, a fibrous ink reservoir contained therein, a nib holder extending from the forward end of said body, said nib holder having external flutes and of external diameter smaller than said body and a nib retained in and projecting from the forward end of said nib holder, said adapter comprising a cylindrical member having a forward segment, a rearward segment and a rearward subsegment said rearward segment including means for being retained in said pen body holder, said means being said subsegment of said rearward segment having an internal diameter adapted to frictionally receive and retain the internal surface of said pen body holder sleeve, said rearward segment having an internal diameter adapted to receive the forward end of said marker body, and said forward segment having an internal diameter and threads adapted to receive and retain said nib holder, said forward segment internal diameter forming an internal shoulder against which said marker body abuts upon maximum threadable engagement of said nib holder in said forward segment, positively positioning said marker body in said adapter.

2. Marker and adapter as recited in claim 1 wherein said nib holder is molded of relatively soft plastic adapted to be self threading upon threaded mating with the internal threaded surface of said forward segment of said adapter.

3. Marker and adapter as recited in claim 1, wherein said adapter rearward segment also includes a forward sub-segment, said forward sub-segment having a larger outer diameter than said rearward sub-segment, said sub-segments defining a shoulder therebetween, said shoulder adapted to stop against a mating forward end of said pen body holder sleeve.

4. Marker and adapter as recited in claim 3, wherein the diameter of said marker body at the forward end thereof is the same as the outer diameter of said adapter as its forward end, said marker and adapter further including a sealing cap adapted to cover, frictionally engage, and seal either the forward end of said marker before it is assembled with said adapetr or the forward end of said adapter with said marker assembled therein.

5. Marker and adapter as recited in claim 1, wherein the diameter of said marker body at the forward end thereof is the same as outer diameter of said adapter at its forward end, said marker and adapter further including a sealing cap adapted to cover, frictionally engage, and seal either the forward end of said marker before it is assembled with said adapter or the forward end of said adapter with said marker assembled therein.

* * * * *